US005219156A

United States Patent [19]

Mori

[11] Patent Number: 5,219,156

[45] Date of Patent: Jun. 15, 1993

[54] AUTOMATIC ORGIINAL SHEET FEEDING APPARATUS

[75] Inventor: Noriyuki Mori, Yokohama, Japan

[73] Assignee: Kabushiki Kaisha Toshiba, Kawasaki, Japan

[21] Appl. No.: 796,839

[22] Filed: Nov. 25, 1991

[30] Foreign Application Priority Data

Nov. 30, 1990 [JP] Japan ..... 2-340517

[51] Int. Cl.[5] ..... B65H 3/06

[52] U.S. Cl. ..... 271/110; 271/122; 271/160

[58] Field of Search ..... 271/10, 157, 3.1, 110, 271/122, 164, 160

[56] References Cited

U.S. PATENT DOCUMENTS 4,458,890 7/1984 Kawazu ..... 271/160 X 4,951,933 8/1990 Mitzel ..... 271/157 X

FOREIGN PATENT DOCUMENTS 300029 12/1988 Japan ..... 271/157

*Primary Examiner*—Richard A. Schacher

*Attorney, Agent, or Firm*—Cushman, Darby & Cushman

[57] ABSTRACT

An original sheet feeding apparatus is provided with a press roller to press sheets placed in a sheet input section thereof against a take-in roller, thereby ensuring that when the number (and therefore, the weight) of the sheets to be fed decreases, the sheets can still be assuredly fed therethrough. The pressing action of the press roller is triggered by a sheet detection device.

3 Claims, 2 Drawing Sheets

AUTOMATIC ORGIINAL SHEET FEEDING APPARATUS

BACKGROUND OF THE INVENTION

1. Field of the Invention

The present invention relates to an automatic original feeder, and more specifically to that of a type in which originals are continuously fed to an original sheet reader apparatus.

2. Description of the Related Art

An automatic original feeder of the above-mentioned type, comprises type has an original input section into which a stack of originals can be input. The originals put into this input section are placed on a take-in roller, and by this roller, they are passed onto separation and paper feed rollers. The stack of the originals are separated one from another by the separation roller, and each of the originals is separately passed onto a paper receiving section by the feed roller.

However, conventional techniques owe their proper operation to the fact that a stack of originals put into the input section presses the take-in roller under its own weight. Consequently when the total weight of the originals is light, and/or the friction coefficient of the discharge roller decreases, the originals, in many cases, are not properly carried due to insufficient frictional force between the originals and take-in roller.

SUMMARY OF THE INVENTION

The present invention has been proposed in consideration of the above problem inevitable in the conventional techniques, and the purpose thereof is to provide an automatic original feeder which can, if the weight of originals is light, or the friction coefficient of the feed roller is low, properly feed the originals.

In order to achieve this purpose, the feeder of the present invention comprises an original input section through which a stack of originals are input, a take-in roller for carrying said originals supplied to the original input portion in a predetermined direction, a take-out roller for further carrying said originals carried by said take-in roller, a separation roller for separating said originals carried by said take-out roller one from another, and a press roller for pressing the originals inserted in said original input section forcibly on said take-in roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will be described in detail with reference to accompanying drawings.

Figure 4:
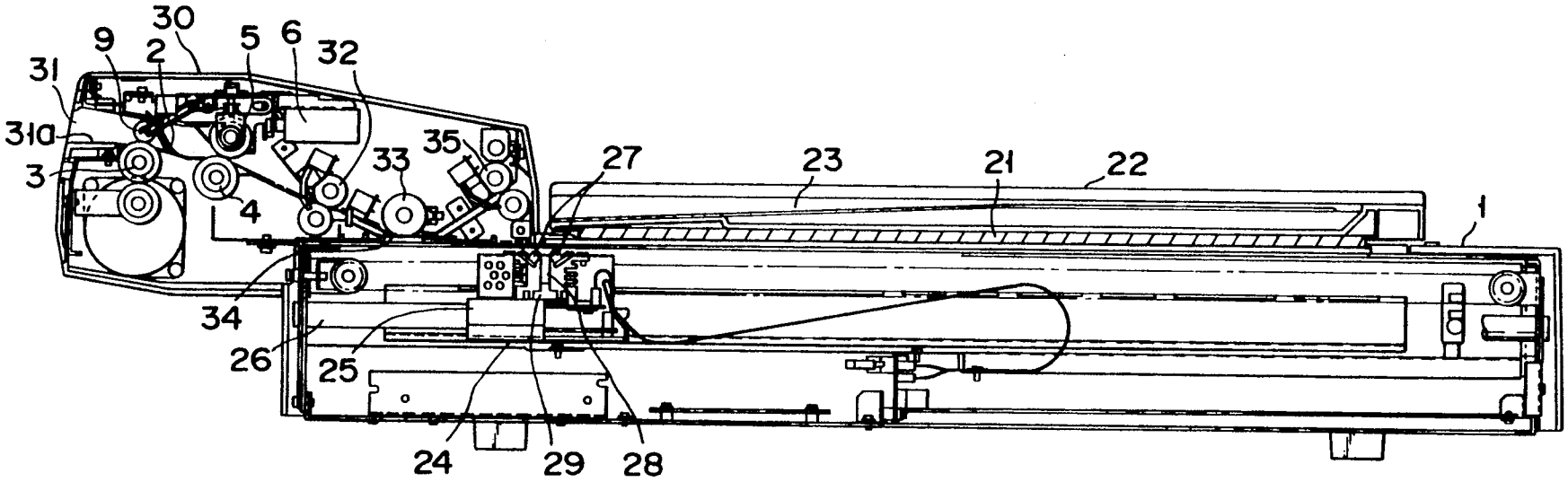
FIG. 4 shows a structure of an original reader comprising the automatic original feeder shown in FIG. 1.

A structure of an original reader is shown in FIG. 4.

A main body 1 of the original reader has an upper surface on which an original placement glass 21 is provided. This original placement glass is covered/uncovered by a cover 22, provided thereon. On a top surface of which an original discharge section 23 is provided.

The main body contains an optical system 24 for reading the image on an original. The optical system 24 includes a carriage 25, which is slidably mounted on a guide rail 26.

On the carriage 25, placed are a pair of LED arrays 27 for irradiating light on original. Between the LED arrays 27, there is provided a rod lens array 28 for guiding the light reflected on the original. Further, underneath the bottom surface of the rod lens array 28, there is provided a CCD 29 for receiving the light emitted from the rod lens array 28.

In the meantime, an automatic original feeder 30 is placed on one side of the main body 1.

Figure 1:
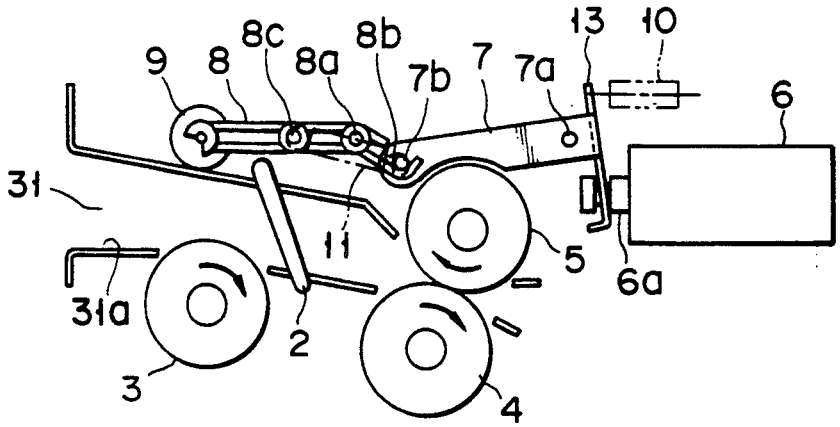
FIG. 1 shows a structure of an automatic original feeder according to an embodiment of the present invention.

This automatic original feeder 30 (see FIG. 1) includes an original input section 31, the bottom surface of which serves as a receiving surface 31*a* for receiving the originals. Further, a take-in roller 3 is provided rotatably on this receiving surface 31*a* for the purpose of carrying the originals in the direction indicated by the arrow illustrated on the roller. On that side of the take-in roller to which an original is conveyed, there is provided a paper feed roller 4 serving as a take-out roller, which is rotatable in the direction indicated by the arrow illustrated thereon. This paper feed roller 4 is engaged with a separation roller 5 located thereon in a surface-by-surface manner, and the separation roller 5 is rotatable in the direction opposite to that of the feed roller 4.

Between the take-in roller 3 and the paper feed roller 4, provided is a detection sensor 2 for detecting whether or not there is an original therebetween.

A self-support type solenoid 6 is located on the front side of the separation roller 5. This solenoid 6 has a plunger 6*a* to which a link 7 serving as the first link member is connected via an operation piece 13. This link 7 is rotatably supported by a shaft 7*a*.

A pick-up support arm 8 serving as the second link member is connected to the distal end of the link 7 by a pin 7*b*. This pick-up arm 8 is rotatably supported by a pivot 8*a*, and a pick-up roller 9 serving as a press roller (press means) is provided at the dorsal end thereof.

The operation piece 13 is urged by a spring 10 designed for reinforcing rotation of the arm 8.

The upper side of a pin receiving portion 8*b* of the arm 8 is cut out such that there is an allowance for play between the pin 7*b* of the link 7 and the pin receiving portion 8*b* of the arm 8.

With this structure, even if the link 7 is often rotated by a certain degree along with attraction and release thereof by the solenoid 6, the movable distance of the pick-up roller 9 in the up and down directions can be adjusted in accordance with the thickness of the stack.

Further, a spring 11 is hooked between the bin 7*b* of the link 7 and the pin 8*c* of the arm. The central axis of this spring 11 never goes up higher than the pivot 8*a* of the arm 8. Thus, even if the movable distance of the pick-up roller 9, which depends on the thickness of a stack of originals, varies, the roller 9 can be always pressed against the stack of originals.

Meanwhile, referring to FIG. 4 an aligning roller pair 32 is located on that side of the paper feed roller 4 to which originals are transferred, and a platen roller 33 is provided on the side of the aligning roller pair 32 to which an originals are transferred. Further, a platen glass 34 is located underneath the platen roller 33, and a discharge roller pair 35 is provided on the side of the platen roller 33 to which originals are carried.

Figure 2:
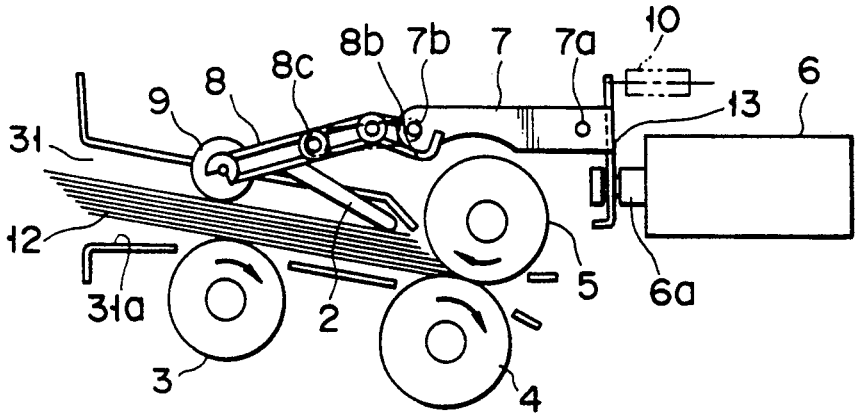
FIG. 2 is an illustration of a feeding operation of the automatic original feeder shown in FIG. 1.

When a stack of originals 12 are inserted to the input section 1 (see FIG. 2), the sensor 2 detects the originals, and causes the take-in roller 3, feed roller 4, and separation roller 5 start to rotate in the direction indicated by the respective arrow illustrated thereon.

At the same time, the sensor 2 causes the solenoid 6 to release the plunger 6*a*, thereby pivoting the link 7 on the pivot 7*a* a little bit in the clockwise direction.

Consequently, the receiving portion 8*b* of the pick-up support arm 8 is released from the state in which the receiving portion 8*b* is pressed downward by the pin 7*b* of the link 7, thereby pivoting the arm 8 on the pivot 8*a* in the counter-clockwise direction. Due to this rotation of the arm 8, the pick-up roller 9 descends onto the originals 12 so as to press the originals against the take-in roller 3. As the take-in roller 3 rotates, the originals are sent up to the contact portion between the feed roller 4 and separation roller 5, where the stack of originals are separated one from another, and each of the originals is passed through the two rollers. After a certain time period, the solenoid 6 is driven to attract the plunger 6*a* back to the original position, and therefore, the above-stated series of the link mechanism proceeds backwards as regards to the case of the release of the plunger 6*a* by the solenoid 6. Thus, the pick-up roller 9 is pulled up.

Each separated sheet of the originals 12 is aligned by the aligning roller pair 32 and sent between the platen glass 34 and platen roller 33. Then, light is emitted from the rod lens array 28 to scan that sheet of the originals now sandwiched between the platen glass 34 and roller 33. The reflected light from the sheet is received by the CCD 29 via the rod lens array 28 so as to read the image on the sheet.

Each of the originals 12 which has passed through the platen glass and platen roller 33 is discharged onto the discharge section 23.

Figure 3:
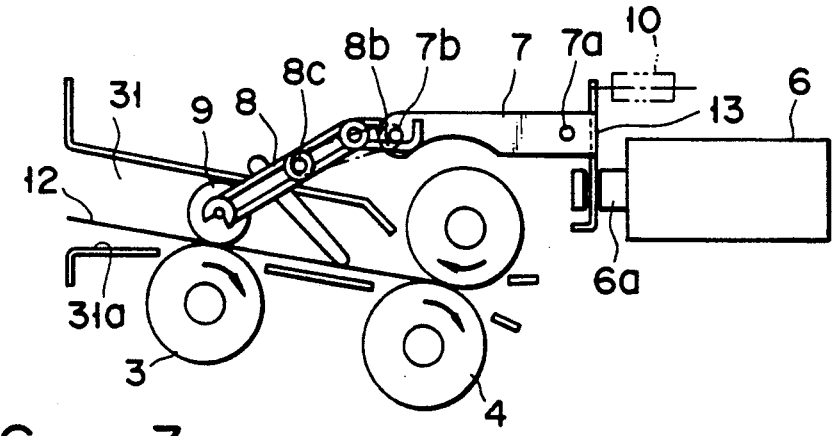
FIG. 3 is another illustration of a feeding operation of the automatic original feeder shown in FIG. 1.

As described, a stack of originals 12 inserted to the input section 1 is pressed forcibly against the take-in roller 3; therefore the pressure force working on the take-in roller 3 from the originals 12 can be made larger than the case where there is no pick-up roller to press originals against a roller. Thus, originals, the weight thereof getting lighter one by one, can be accurately sent to the next step to the very last sheet, as can be seen FIG. 3.

To summarize, according to the present invention, originals can be pressed against the take-in roller, increasing the pressure force of the originals against the take-in roller. Therefore, even if the stack of the originals becomes thinner as the original feeding operation proceeds, or the frictional force between the originals and the take-in sheet is decreased, the appropriate feeding of the originals to the reader can be ensured.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents

What is claimed is:

1. An automatic sheet feeder comprising:

a sheet input section through which a stack of sheets are input;

a take-in roller for feeding said sheets supplied to the sheet input section, in a predetermined direction;

a take-out roller for further carrying said sheets fed by said take-in roller;

a separation roller for separating said sheets carried by said take-out roller one from another;

a press roller for pressing said sheets input to said sheet input section, forcibly on said take-in roller;

a drive power source including a plunger for moving said press roller toward or away from said take-in roller;

an operation piece, an end of which is connected to said plunger such that said operation piece rotates along with forward/backward movements of said plunger;

a first urging member connected to the other end of said operation piece to apply a rotational force to said operation piece;

a first link having an end connected to said operation piece via a securing pin, and the other end provided with a connecting pin;

a second link having an end rotatably pivoted a shaft, said end provided with a pin receiver for receiving said connecting pin of said first link, and the other end provided with said press roller;

a pin provided in a mid-portion of said second link;

a second urging member stretched over said pin and said connecting pin of said first link so as to urge said press roller toward said take-in roller; and detecting means for sending an instruction for starting an operation to said take-in roller, take-out roller, and separation roller, upon detection of said sheet input to said sheet input section.

2. The automatic sheet feeder as claimed in claim 1, wherein the detection means includes a sensor.

3. The automatic sheet feeder as claimed in claim 1, wherein each said first and second urging member is a spring member.

* * * * *